US010113305B2

(12) United States Patent
Radford

(10) Patent No.: US 10,113,305 B2
(45) Date of Patent: Oct. 30, 2018

(54) LOAD BEARING INTERLOCKING STRUCTURAL BLOCKS AND TENSIONING SYSTEM

(71) Applicant: JUST BIOFIBER CORP., Calgary (CA)

(72) Inventor: William Radford, Calgary (CA)

(73) Assignee: JUST BIOFIBER STRUCTURAL SOLUTIONS CORP., Calgary (CA)

( * ) Notice: Subject to any disclaimer, the term of this patent is extended or adjusted under 35 U.S.C. 154(b) by 0 days.

(21) Appl. No.: 14/815,836

(22) Filed: Jul. 31, 2015

(65) Prior Publication Data

US 2017/0030069 A1 Feb. 2, 2017

Related U.S. Application Data

(60) Provisional application No. 62/032,192, filed on Aug. 1, 2014, provisional application No. 62/100,790, filed on Jan. 7, 2015.

(51) Int. Cl.

| | |
|---|---|
| ***E04B 1/02*** | (2006.01) |
| ***E04B 1/06*** | (2006.01) |
| ***E04C 1/39*** | (2006.01) |
| ***A63H 33/04*** | (2006.01) |
| ***E04C 3/28*** | (2006.01) |

(Continued)

(52) U.S. Cl.

CPC ..... *E04B 1/06* (2013.01); *A63H 33/04* (2013.01); *A63H 33/042* (2013.01); *A63H 33/044* (2013.01); *E04C 1/39* (2013.01); *E04C 3/28* (2013.01); *E04C 3/22* (2013.01); *E04C 5/08* (2013.01)

(58) Field of Classification Search

CPC ..... E04B 2002/0254; E04B 1/06; E04C 1/39; E04C 5/08

See application file for complete search history.

(56) References Cited

U.S. PATENT DOCUMENTS

| | | | |
|---|---|---|---|
| 3,067,806 | A | 12/1962 | Trelease |
| 3,170,267 | A | 2/1965 | Rosenfeld |
| 3,267,972 | A | 8/1966 | Thompson |

(Continued)

FOREIGN PATENT DOCUMENTS

| | | | |
|---|---|---|---|
| EP | 2775056 | A1 | 9/2014 |
| FR | 2836498 | A1 | 8/2003 |

(Continued)

OTHER PUBLICATIONS

Ballustrade Installation Instructions for Tensioner Swage Stud System; entire Video; Miami Stainless, Jul. 3, 2013.*

*Primary Examiner* — Gisele D Ford
(74) *Attorney, Agent, or Firm* — Bennett Jones LLP

(57) ABSTRACT

Construction materials intended for use as structural elements, such as structural blocks, used in the construction of buildings and civil engineering structures. The blocks can comprise hemp hurd and fibers, flax fiber, hydraulic lime and hydrated lime. In one aspect, the blocks may comprise a body shape configured so as to allow it to interlock with other blocks in the construction of a structure. In another aspect, the blocks may be adapted to incorporate tensioning means. Methods for manufacturing the blocks and structures comprising such materials and methods for building such structures are also disclosed.

12 Claims, 22 Drawing Sheets

(51) Int. Cl.
*E04C 5/08* (2006.01)
*E04C 3/22* (2006.01)

(56) References Cited

U.S. PATENT DOCUMENTS

| | | | | |
|---|---|---|---|---|
| 3,382,632 | A * | 5/1968 | Grofcsik | E04B 2/10 52/223.7 |
| 3,537,687 | A | 11/1970 | Adelman | |
| 3,618,279 | A | 11/1971 | Sease | |
| 4,436,447 | A * | 3/1984 | Crowe | E02B 3/123 405/15 |
| 4,965,979 | A * | 10/1990 | Larrivee | E04C 1/395 405/284 |
| 5,138,808 | A * | 8/1992 | Bengtson | E04B 1/06 52/204.2 |
| 5,901,520 | A | 5/1999 | Abdul-Baki | |
| 5,987,840 | A * | 11/1999 | Leppert | E04B 2/08 52/592.5 |
| 6,050,044 | A | 4/2000 | McIntosh | |
| 6,088,987 | A * | 7/2000 | Simmons | E04B 2/14 405/285 |
| 6,161,357 | A * | 12/2000 | Altemus | E04B 2/18 446/124 |
| 6,282,859 | B1 * | 9/2001 | Van Der Heijden | E04B 2/08 403/305 |
| 6,513,296 | B1 * | 2/2003 | Baden | E04B 2/16 411/521 |
| 6,571,525 | B2 * | 6/2003 | Coleman | E04B 2/08 446/125 |
| 6,588,168 | B2 * | 7/2003 | Walters | E04B 2/14 52/604 |
| 6,758,020 | B2 * | 7/2004 | Cerrato | E04B 1/703 52/223.7 |
| 6,996,945 | B2 | 2/2006 | Doty | |
| 7,264,462 | B2 | 9/2007 | Vaders | |
| 7,694,485 | B1 | 4/2010 | Siener | |
| 8,414,816 | B2 | 4/2013 | Korman et al. | |
| 8,448,410 | B2 | 5/2013 | Korman et al. | |
| 8,464,482 | B2 * | 6/2013 | Raynor | E04C 3/34 52/169.9 |
| 2002/0014050 | A1 * | 2/2002 | Van Der Heijden | E04B 2/08 52/585.1 |
| 2004/0020145 | A1 * | 2/2004 | Matsufuji | E04B 2/42 52/223.7 |
| 2005/0081465 | A1 * | 4/2005 | Crumley | E04H 9/14 52/223.1 |
| 2007/0056235 | A1 * | 3/2007 | Kohler | E04G 21/12 52/223.7 |
| 2007/0186502 | A1 * | 8/2007 | Marsh | E04B 2/16 52/604 |
| 2007/0245673 | A1 * | 10/2007 | Cerrato | E04B 2/18 52/607 |
| 2007/0271868 | A1 * | 11/2007 | Abella | E04B 2/08 52/600 |
| 2008/0098687 | A1 * | 5/2008 | Marsh | E04B 2/16 52/606 |
| 2008/0245005 | A1 * | 10/2008 | Fennell | E04C 1/40 52/223.7 |
| 2008/0256894 | A1 * | 10/2008 | Marsh | E02D 27/02 52/719 |
| 2008/0272270 | A1 | 11/2008 | Robin et al. | |
| 2009/0313923 | A1 * | 12/2009 | Bucheger | E04B 2/44 52/223.7 |
| 2013/0205703 | A1 | 8/2013 | Baumer | |
| 2014/0090325 | A1 | 4/2014 | Maeers | |
| 2014/0202111 | A1 * | 7/2014 | Drew | E04B 2/16 52/589.1 |

FOREIGN PATENT DOCUMENTS

| | | | |
|---|---|---|---|
| GB | 2363808 | A | 1/2002 |
| GB | 2420354 | A | 5/2006 |
| GB | 2454259 | A | 6/2009 |
| KR | 100899779 | B1 | 5/2009 |
| WO | 2014072533 | A1 | 5/2014 |

* cited by examiner

LOAD BEARING INTERLOCKING STRUCTURAL BLOCKS AND TENSIONING SYSTEM

FIELD OF THE INVENTION

The invention disclosed herein relates to particular construction materials, as well as processes for preparation and uses of such materials. Such materials may be intended for use as structural elements, such as structural blocks, used in the construction of buildings and civil engineering structures.

BACKGROUND OF THE INVENTION

The production of blocks for masonry using vegetal additions incorporated in a lime-based binder matrix (for example hemp used to produce Chanvribloc™ blocks) is a known process in the art.

The prior art also discloses blocks used in the construction of structures, such as houses and commercial buildings, which may have properties that are either insulating or load bearing.

WO 2014072533 discloses an insulating construction material with an alleged low thermal conductivity comprising vegetal additions, as well as to a process for preparation and to uses of such a material.

It would be advantageous for there to be a structural block that had a composition and configuration that integrated both load bearing capabilities with insulating properties.

It would also be advantageous for there to be further means for providing additional reinforcement and tension bearing capabilities to a structural block.

SUMMARY OF THE INVENTION

The invention disclosed herein relates to particular construction materials, as well as processes for preparation and uses of such materials. Such materials may be intended for use as structural elements, such as structural blocks, used in the construction of buildings and civil engineering structures. When the materials are used in the production of structural blocks, such blocks may integrate load bearing capabilities together with insulating properties. In one embodiment, the block of the present invention may be further adapted so as to accommodate a tensioning system that can provide tension. As such, the block of the present invention may be adapted so as to be tension bearing as well.

In accordance with an aspect of the present invention, structural blocks are provided that may be configured to interlock with complimentary blocks in the construction of a structure. In one embodiment, the structural block may accommodate an embedded member or strut protruding from the surface of one side of the block and a recess on another side.

In accordance with a further embodiment of the present invention, a structural block tensioning system is provided for contributing to the tension bearing attributes of a structure, the system comprising a plurality of structural blocks, each structural block having opposed top and bottom surfaces, opposed side surfaces and opposed end surfaces, a plurality of members embedded within each structural block, one end of each member extending from one surface of the structural block, wherein one or more of the embedded members comprises a lengthwise cavity therethrough, a plurality of apertures extending within the structural block from an opposed surface of the structural block, the apertures adapted for engaging with an extending end of an adjacent structural block, and tensioning means positioned within the lengthwise cavity of the one or more embedded members, wherein the cavities in the embedded members of adjacent structural blocks align to form a conduit for receiving the tensioning means.

In accordance with another aspect of the present invention, a method of manufacturing a structural block tensioning system for contributing to the tension bearing attributes of a structure is provided, comprising assembling a plurality of interlocking structural blocks, wherein each block comprises a plurality of embedded members and a plurality of apertures, one end of each member extending from a surface of the block, and the apertures extending within the block from an opposed surface of the block, the apertures adapted for engaging with an extending end of an adjacent structural block, forming a lengthwise cavity in one or more of the embedded members, adjoining the plurality of interlocking structural blocks by inserting the extending ends of the embedded members of a structural block into the apertures of an adjacent block, wherein the cavities of the one or more embedded members of adjacent blocks are aligned to form a conduit, passing a tensioning means through the lengthwise cavities of the one or more embedded members of adjoined structural blocks, and tightening the tensioning means.

A further aspect is the use of the structural block tensioning system of the present invention in the manufacture of a floor, wall or roof of a structure.

Another aspect is the use of the structural block tensioning system of the present invention in the manufacture of a structure.

Further aspects, features and advantages of the present invention will be apparent from the following descriptions and claims.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and accompanying drawings in which:

DESCRIPTION OF THE PREFERRED EMBODIMENT

The present invention relates to particular construction materials, as well as processes for preparation and uses of such materials. When describing the present invention, any term or expression not expressly defined herein shall have its commonly accepted definition understood by those skilled in the art. To the extent that the following description is of a specific embodiment or a particular use of the invention, it is intended to be illustrative only, and not limiting of the invention, which should be given the broadest interpretation consistent with the description as a whole.

The construction materials of the present invention are intended for use in structural elements for building structures and civil engineering structures.

In one embodiment, the materials are used in the production of structural blocks. In one aspect, the blocks of the present invention may be designed so as to integrate compression and torsional load bearing capabilities with insulation properties.

Figure 1:
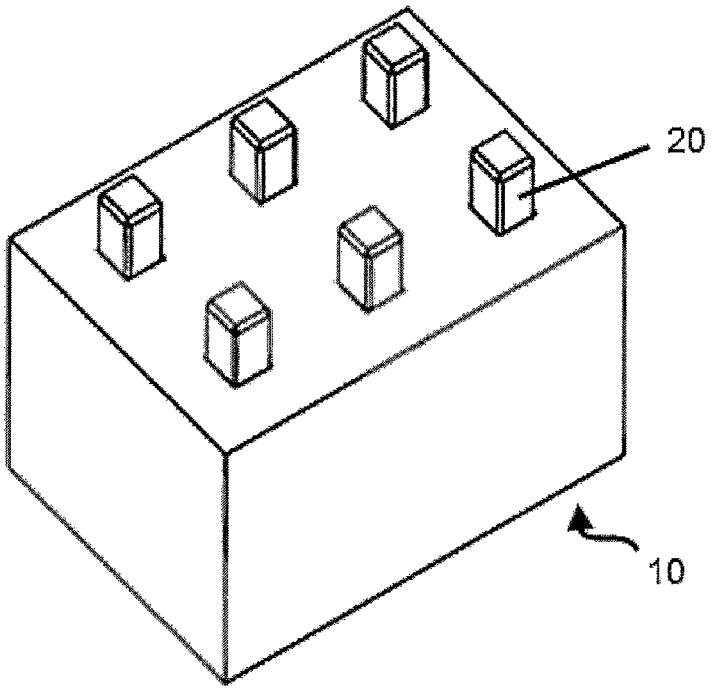
FIG. 1 is a front perspective view of a structural block in accordance with the present invention.
Figure 2:
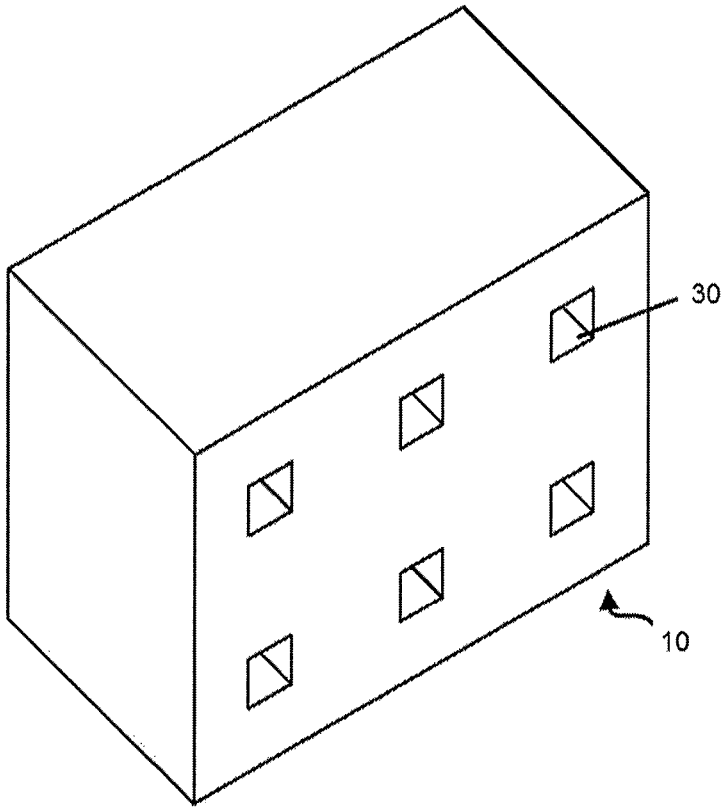
FIG. 2 is a rear perspective view of the structural block of FIG. 1.
Figure 3:
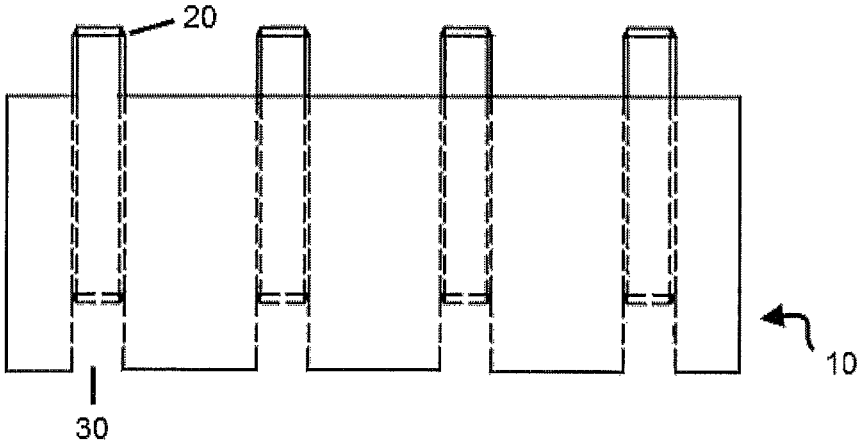
FIG. 3 is a cross sectional side view of the structural block of FIGS. 1-2.

FIGS. 1-3 illustrate structural blocks 10 in accordance with preferred embodiments of the present invention. As illustrated in FIGS. 1-3, each block 10 of the present invention may comprise a body shape configured so as to allow it to interlock with other blocks when constructing a structure, such as a wall or house. Such design can provide further strength to the overall structure.

In one embodiment, each block 10 can accommodate one or more embedded member 20. The member 20, which may also be termed a strut in the art, may be embedded within the block 10 or inserted during building construction and may contribute to the load bearing properties of the block, particularly compression loads. One end of the embedded member 20 may protrude out a given distance from one side of the block 10, while the opposite end of the embedded member 20 may terminate partway within the block 10 on an opposite side.

In another embodiment, the embedded member 20 may be flush with the surface of the block and a positioning device may also be used to align and join the members together. For example, a tube with directional clips may be used between blocks to grip the abutting member ends in adjacent blocks.

Referring back to the drawings, as depicted in FIGS. 2 and 3, a recess or opening 30 can be formed within the block 10 and can extend from the terminating end of the embedded member 20 within the block through to the surface of a side of the block 10, opposite to the side through which the embedded member protrudes.

In one embodiment, the extended end of the embedded member 20 may protrude from the block 10 by a distance that is approximately equivalent to the depth of the recess 30 within the block. By way of example, a block with a height of 8 inches may accommodate an embedded member that is 8 inches in length. The protruding end of the member may extend 2 inches out from the surface of one side of the block, with the remaining 6 inches embedded within the block. A recess formed within the block at the member's opposite end may be 2 inches in depth. The recess may extend immediately from the terminating end of the embedded member housed in the block, to the surface of the opposite side of the block.

A recess 30 can be of a size, shape and may be spaced apart from one another so as to align with and accommodate the protruding end of an embedded member of another block. Such an arrangement may be similar to an interlocking "pin and socket" arrangement and can function as a locating means for the purpose of accurately positioning a block with respect to an additional block(s) while also contributing to the load bearing attributes of the block under compression.

When the protruding end of an embedded member of one block is positioned into the corresponding recess of a second block, the protruding end of the embedded member may be in direct contact with the terminating end of the embedded member of the second block. As a result, the blocks can be said to auto align, and the embedded members can be said to form a stacked structure forming a load bearing structural member.

For ease of assembly, a recess within the block may have a width that is some measurement greater than the width of the embedded member. In one embodiment, the width of the recess may be ¼ inch wider than the width of the member, for example, ⅛ inches on either side of the recess (on each of the four sides when the block and recess are square), to accommodate ease of insertion of the protruding member of an adjacent block.

Any suitable binding agent, such as lime mortar for example, may be used to bind the protruding end of an embedded member of one block into the corresponding recess of a second block. Such a bond, when formed, may be stronger than the block itself.

When the embedded member and corresponding recess are interlocked, a molecular bond may be formed that can contribute to the load bearing or other structural properties of the block. In some instances, the load bearing capabilities of the block of the present invention may be several times greater than that of a hollow concrete block, and more similar to or exceeding that of a conventional stud-framed wall structure.

Figure 4:
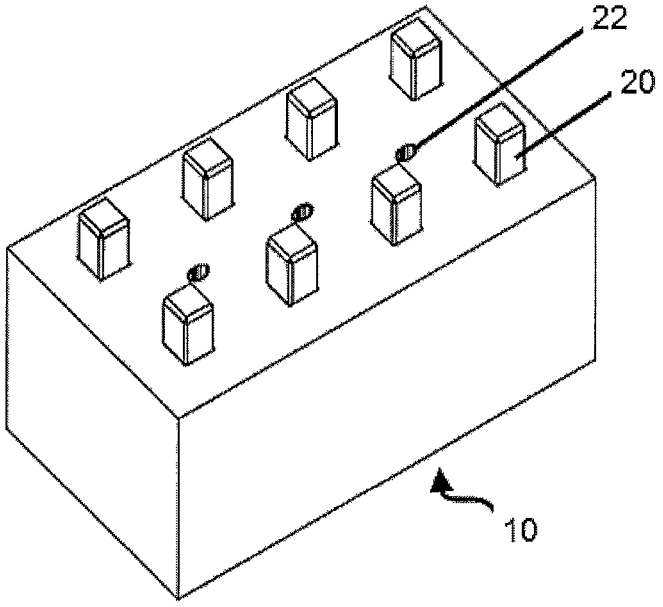
FIG. 4 is a front perspective view of an alternate structural block comprising conduits therethrough.
Figure 5:
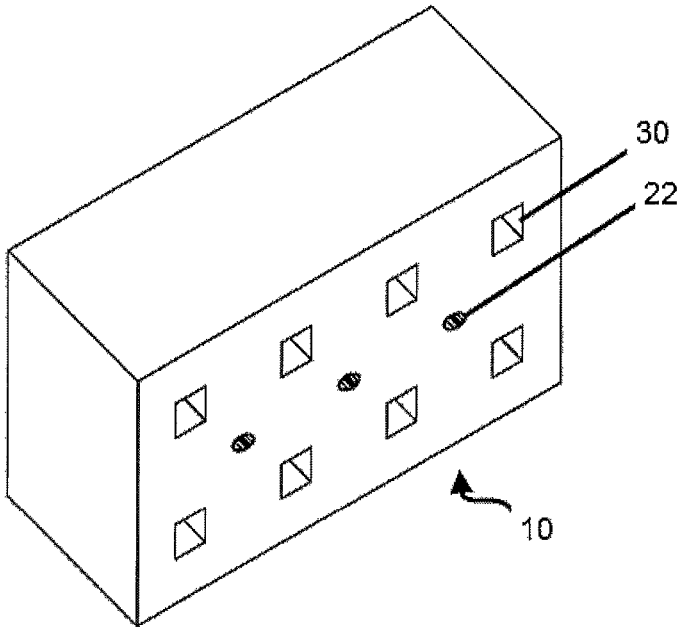
FIG. 5 is a rear perspective view of the structural block of FIG. 4.
Figure 6:
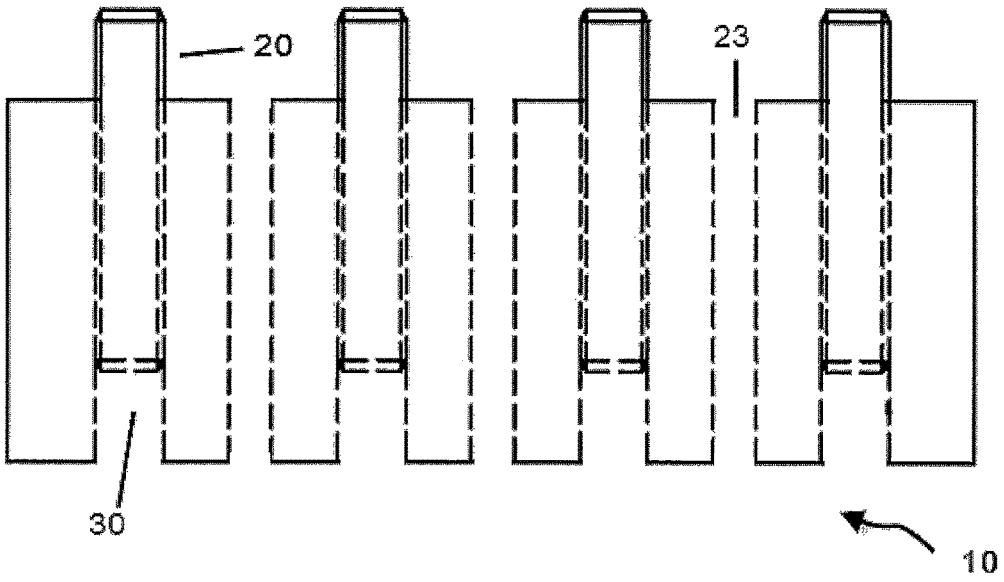
FIG. 6 is a cross sectional front view of the structural block of FIG. 5.
Figure 7:
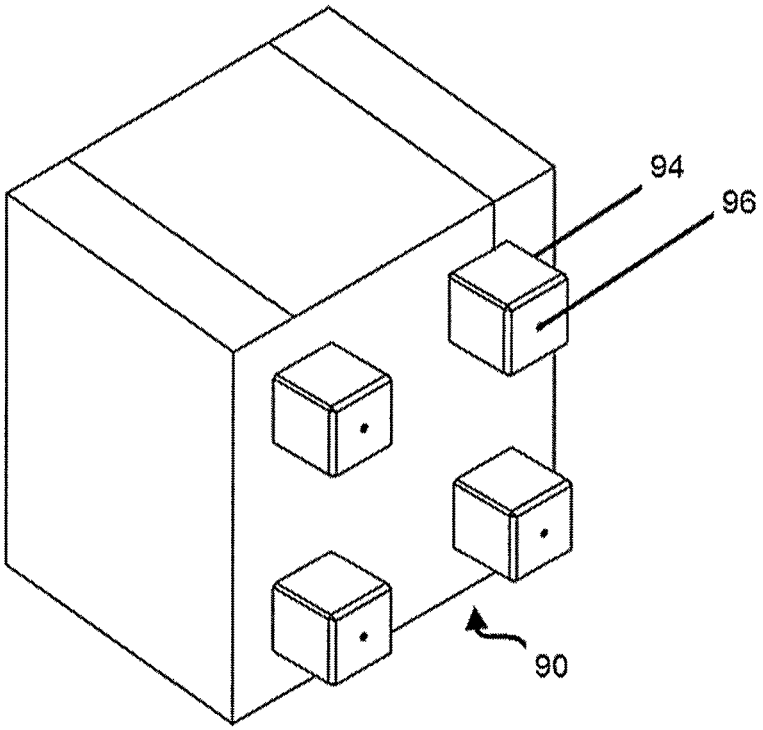
FIG. 7 is a front perspective view of a structural block adapted to accommodate a tensioning system therethrough in accordance with the present invention.
Figure 8:
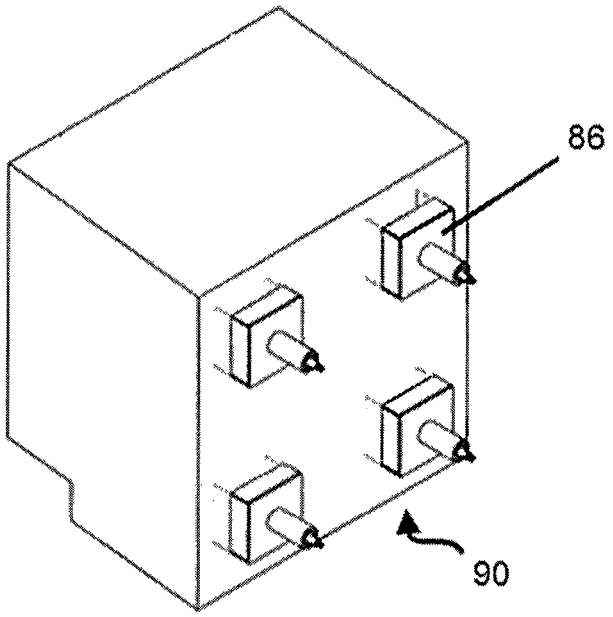
FIGS. 8-9 show alternate perspective views of structural blocks adapted to accommodate a tensioning system in accordance with the present invention.
Figure 9:
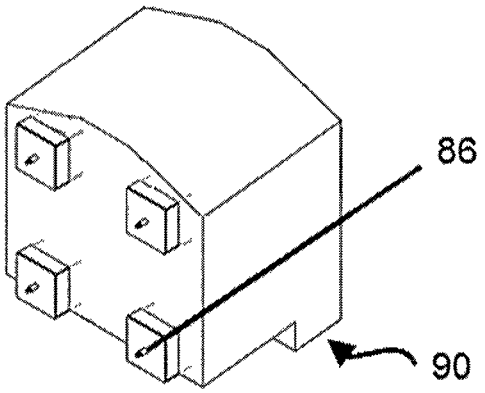

In another embodiment, holes 22 may be created on the block 10 that may be positioned an equal distance between the embedded members 20, as illustrated in FIGS. 4-5, the holes 22 may be used to create a conduit to accommodate electrical wiring or other utilities inside, for example, a structure's wall. The holes 22 may also be beneficial to the curing process, by exposing the block's interior, for example, to injected carbon dioxide. In an alternate embodiment, some strut members may be hollow and slotted. As illustrated in FIG. 6, in another embodiment, additional perforated tubes or struts 23 may be incorporated in the blocks 10 therethrough.

The composition of the member or strut 20 itself may comprise any rigid material or mixtures thereof, with any preferences to materials used directed to cost considerations and load bearing capabilities of the material. In a preferred embodiment, the embedded member may comprise any wooden material, such as fir, spruce, pine, cedar, etc. The element may also comprise composites of organic or inorganic fibers, such as hemp or carbon fiber, etc. In yet a further embodiment, the embedded member may comprise a blend of bio fibers and polymers, such as polyethylene, polypropylene or polyester. Some compatible metals may also be used. A member or strut may also be hollow, such as a hollow square or cylindrical tube. Other materials may include metals, carbon fibre or composites, 3D printed or extruded plastics or any suitable structural members.

Tensioning System

In one embodiment, the block of the present invention may be adapted so as to be tension bearing as well. As illustrated in FIGS. 7-12, a block 90 may be further adapted so as to accommodate a tensioning system that can provide tension. In such an embodiment, the embedded member 94 of the block 90 can accommodate a tensioning means 96 though the length of the member 94, such tensioning means entering through the one end of the member 94 and exiting through the other end of the member 94.

In one embodiment, the tensioning means 96 may be a cable, such as, for example, a tensioned non-stretch stainless steel cable. In an alternate embodiment, the system may comprise a rod.

Figure 10:
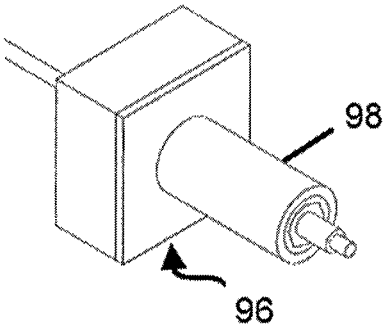
FIG. 10 is a perspective view of an embodiment of a tensioning system comprising a hex swage tensioner in accordance with the present invention.

As illustrated in FIG. 10, when the tensioning system 96 includes a cable, the tensioning end assembly can comprise a hex swage tensioner 98, in addition to the cable.

Figure 11:
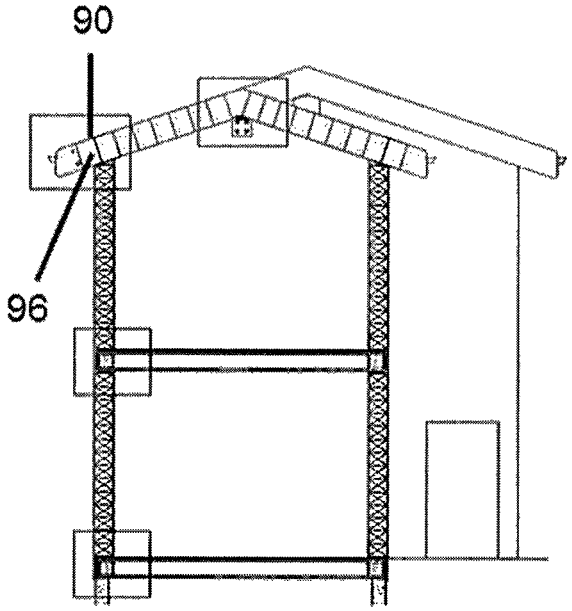
FIG. 11 is a front view of a structure comprising a plurality of structural blocks adjoined together through a tensioning system in accordance with the present invention.
Figure 12:
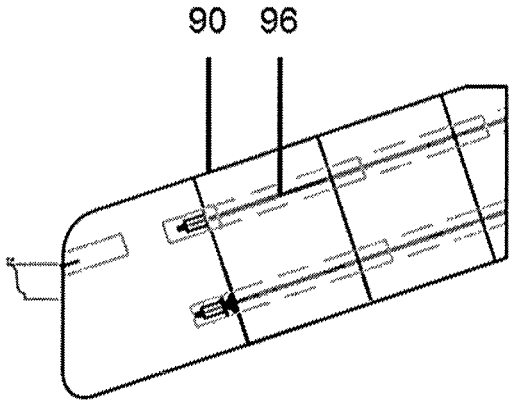
FIG. 12 is a front close-up view of the structural blocks of FIG. 11.

As illustrated in FIGS. 11-12, when assembled, the embedded members of each block can be aligned with the corresponding members of other blocks, to allow the passage of the tensioning means through multiple embedded elements and blocks.

Such a configuration provides a further fastening means for a structure comprising the blocks of the present invention. In particular, such a configuration may be tension bearing, in that the blocks may be adjoined together through tension suitable for non-vertical structural elements such as floors, walls, pitched or flat roof surfaces, etc.

Figure 13:
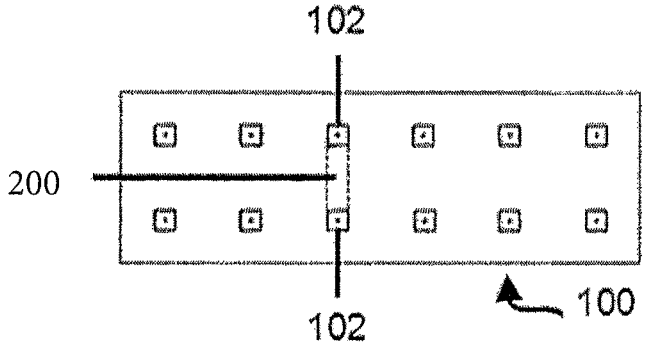
FIG. 13 is a front view of an embodiment of a structural block adapted to accommodate a compression strut in accordance with the present invention.
Figure 14:
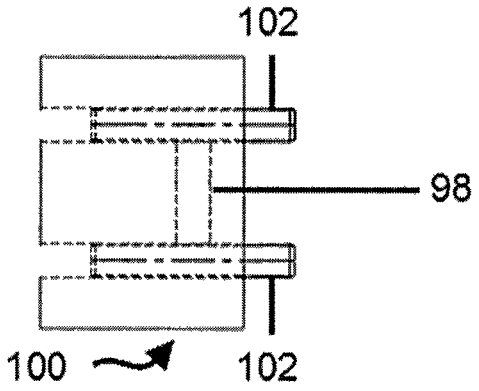
FIG. 14 is a side view of the structural block of FIG. 13.
Figure 15:
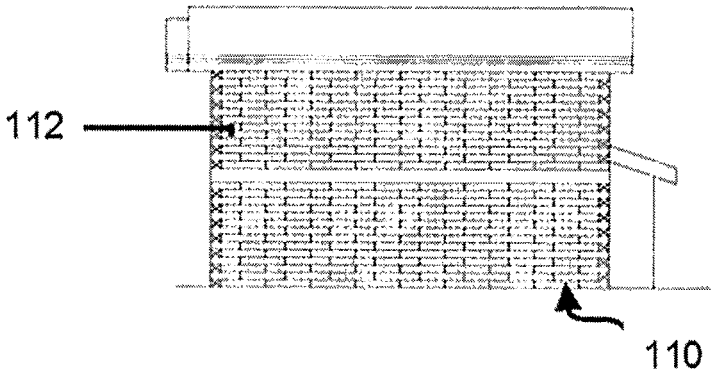
FIGS. 15-18 depict various views of a structure comprising structural blocks in accordance with the present invention.
Figure 16:
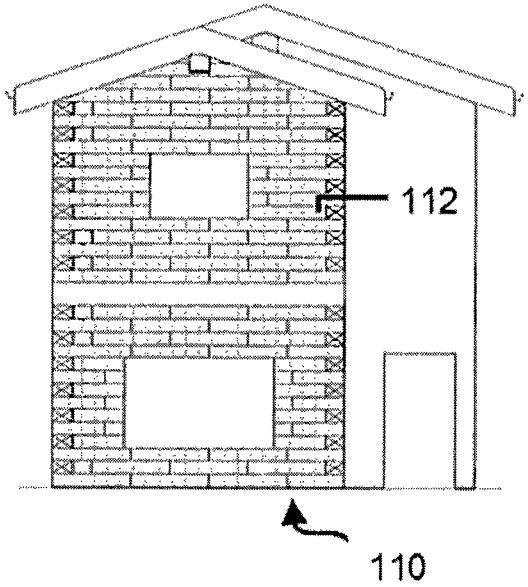
Figure 17:
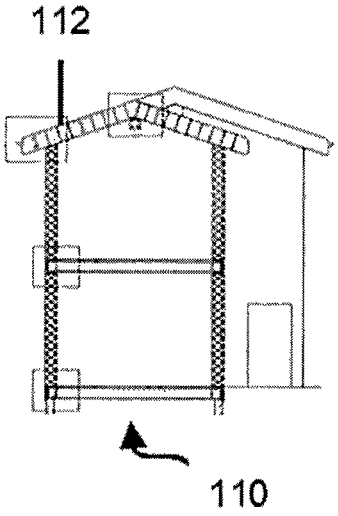
Figure 18:
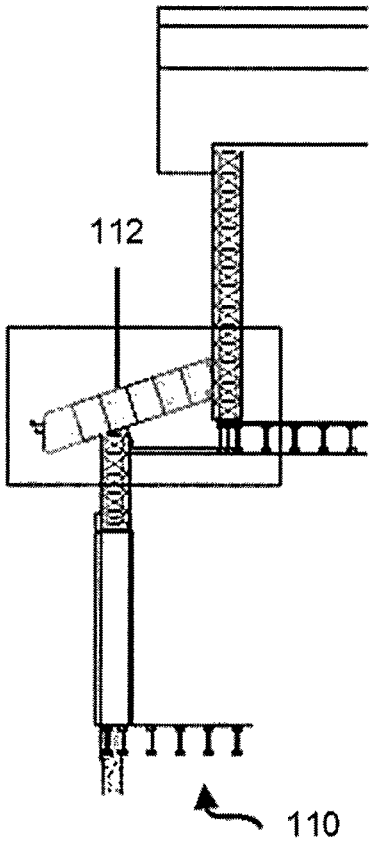
Figure 19:
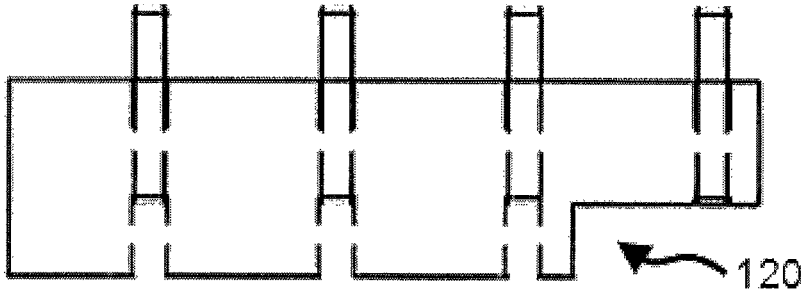
FIGS. 19-22 show structural blocks comprising a variety of alternative configurations in accordance with the present invention.
Figure 20:
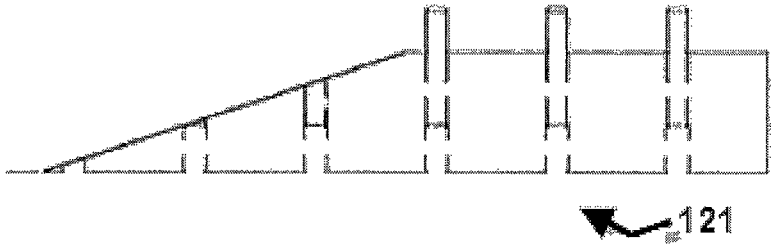
Figure 21:
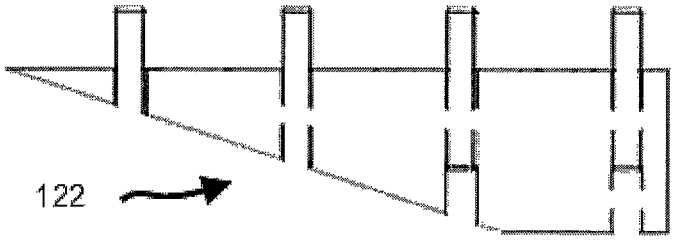
Figure 22:
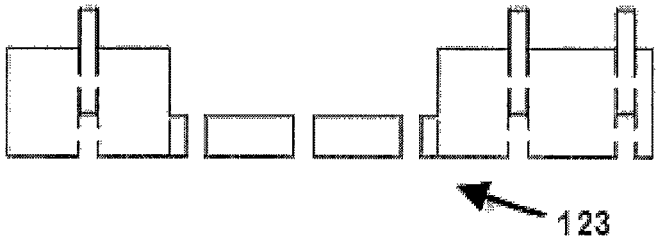

In another embodiment, an additional member, which may be termed a compression web 200, can be used for the purpose of increasing the compression strength of the structural element formed by tensioned blocks. As illustrated in FIGS. 13-14, a compression web 200 may, for example, be placed approximately perpendicular between and in contact with a pair of existing members or struts 102 integrated into the body of the block 100 each of which accommodates a cable as tensioning means. The application of the compression web 200 in this embodiment may assist in keeping the embedded member pair properly spaced, without needing structure inherent in the block material, keeping the adjacent pairs of tensioned struts and cable or rod essentially equidistant throughout their length.

Other elements such as strut caps 86 and/or mounting plates may be used in accordance with the present invention. By way of example, a strut cap may be set into a block over the protruding end of an embedded member, with the extending end extruding from the cap.

In practice, the tensioning means may be tensioned post construction, after the blocks have been aligned.

When the tensioning means comprises a cable, the tensioning procedure with regard to a roof, for example, may include the following steps:

(i) Beams may be assembled using the tension blocks on a flat horizontal surface and pre tensioned by use of cables and lifted into position. Alternatively scaffolding would be required to assemble in place and post tension the blocks using cables.

(ii) Once the roof is constructed (minus the end caps) the non-swaged end of the cable is fed through the embedded member, starting at the peak of the roof.

(iii) The cable is pulled taught.

(iv) The second end of the cable is swaged as close to the hex tensioner as possible.

(v) The hex tensioner is tightened as much as needed.

In one embodiment, the frequency of tensioning means may need be applied only as required, for example, every meter of the assembled structure, to form a floor, roof, or other non-vertical structure, or can be a wall.

Bio-Fiber Structural Block

In a preferred embodiment, the body of the block of the present invention can comprise a primarily fibrous and lime composition. Specifically, the composition for each block may comprise the following components:

(i) hemp hurd, and fibers (ii) flax fiber (iii) hydraulic lime (iv) hydrated lime Certain benefits may be realized through the practice of a block comprising the preferred composition of the present invention. Compositions comprising hemp hurd, flax, hydraulic lime and hydrated lime may be environmentally sustainable, recyclable and may sequester carbon dioxide from the atmosphere, while providing exceptional insulating qualities.

While a concrete block may need to be restricted in size, for example 16 inches, due to weight for handling, a block of the present invention may have a length of 48 inches or more and may maintain ease of handling because of its lower density, for example, 300 kg/cubic meter.

The lime component may primarily act as a binding agent, holding the other components together. However, any suitable binding agent may be substituted in instances, for example, when a stronger bonding agent may be required. Suitable alternative binding agents can include polymer based agents, for example silica sand, pozzolans, polyester resins, or Portland or similar cement or plaster. Such alternative agents may also be used in combination with the lime component of the preferred embodiment.

The hemp hurd and fiber component can provide insulating properties, bulk, support and strength to the block and structural members in the block. However, any alternate material or combination of materials that can provide similar desirable properties may be used in the alternative. Some organic alternatives include fibrous materials, such as corn stocks, cereal grain, straw, etc. Hemp hurd is a preferred material, primarily due to its insulating qualities in relation to the other fibers.

Alternatively, non-organic materials such as Styrofoam/polystyrene or non-recyclable plastics may be used. Such materials may also be used in a shredded form. Structural fibers (oriented cellulose strands, plastics, metal or carbon filaments) may also be incorporated or substituted. The application of these non-organic alternatives may provide an additional advantage, in that such non-recyclable materials may be sequestered from the environment, or may add different qualities to the blocks (strength, conductivity, electrical or RF shielding, noise abatement, etc.).

Recyclable and Sustainable

The composition of a preferred embodiment comprises hemp hurd, flax, hydraulic lime and hydrated lime. The primarily fibrous-lime combination is organic and composed of bio-recyclable material. When the useful life of a structure that uses such blocks comes to an end, its components may be recycled. For example, the entire block may be ground up and remixed for further subsequent applications.

The components of the composition are also sustainable. For example, hemp hurd, in addition to its favorable properties, is readily available in supply and grows very quickly with little water and fertilizer.

Other favorable properties may be realized by the fibrous-lime composition of the preferred embodiment. In particular, such a combination allows the building to "breathe". Air and humidity can pass both in and out of the blocks at a very slow rate. No vapor barrier may be required to be used.

The composition may also be resistant to mold, termites and other insect pests.

A structure using the block composition of the preferred embodiment may allow for fire resistance, due to the properties of the hemp hurd and lime mixture, or other compositions.

In another embodiment, the blocks of the present invention may be further coated with a lime finish. A block of the present invention may be coated with several, for example five or more, coats of lime.

A structure using the blocks of the present invention can be bonded to become monolithic. Such properties can be especially beneficial particularly in areas prone to earthquakes, hurricanes or tornadoes.

Water proofing or moisture resistant properties may also be realized, particularly by use of the lime component. The lime component can also allow a block of the preferred embodiment to "heal" itself. For example, a crack in the lime coating can close over time when it is subjected to moisture.

Carbon Dioxide Sequestration

The carbon dioxide sequestration properties of a block that comprises the preferred composition of the present invention allows for the removal and sequestration of the greenhouse gas carbon dioxide from the Earth's atmosphere.

The hemp hurd component of the composition can sequester carbon dioxide at a rate of over approximately 20 tonnes per hectare as the plants grow.

It is estimated that the hemp hurd-lime composition blocks of the preferred embodiment have the capability to capture/absorb over approximately 100 kilograms of carbon dioxide per cubic meter. The lime component can use carbon dioxide to cure and set the mixture. An average house comprising such blocks, for example, can capture approximately 13,000 kilograms of carbon dioxide during block production and can continue absorbing carbon dioxide for approximately 100 years.

Methods of Manufacture

The fabrication of the blocks of the present invention may be attained by means using a mold process.

During manufacture, the embedded members or struts may be cut to the desired length, such as, for example, 8 inches in length. A hole may be drilled through the lengths of the bodies of those members that will serve as conduits for the tensioning means.

A desired number of struts and perforated tubes are placed into a mold at the desired positions, in a jig.

A mixture comprising the components of the block's composition may be combined and mixed. The mixture may then be, for example, poured, sprayed or injected into the mold.

The composition may be compressed and/or heated and allowed to set. During the curing process, carbon dioxide may be injected or passed by (or through conduits within) the curing block, which decreases the cure time. Depending on the lime composition used, the blocks may also be cured in an autoclave to control the temperature, humidity and carbon dioxide environment.

A lime coating may be applied to the inner and outer face of the blocks at time of manufacture which may increase the block strength and reduce construction finishing time.

The blocks of the present invention may be pre-manufactured and then cut as desired on site.

Building Structure and Related Materials

A structure 110 and related building materials is also disclosed by the present invention, as illustrated in FIGS. 15-18. FIGS. 19-22 depict structural blocks 120, 121, 122, 123 comprising a variety of alternative configurations, as examples.

In a preferred embodiment, such building materials may include blocks 112 as disclosed in the present invention. Consequently, the blocks used in the structure of the present invention may be load bearing, tension bearing and insulating.

The blocks 112 used may be of standard building construction dimensions. Height width and length may vary, depending upon the application, orientation and desired insulation requirements. For example, the blocks used for the walls of a structure may be a standard 11" thick and 8" high, while varying in length. Roof structure blocks may be 12" high and 16" wide.

The building materials may also be pre-manufactured prior to being transported to an intended building site for assembly.

A 1400 square foot house structure is provided by way of example below.

Wall Blocks

The wall blocks can be of a standard height and width, and may vary in the length. The wall blocks may be a standard 11" deep and 8" high, and may vary in the length. The total count below includes blocks that may be cut on site.

4": 8
8": 12
12"-2 struts: 13
12"-4 struts: 29
16": 7
20": 13
24": 63
32": 97
36": 43
48": 644
Total wall block count: 929
48" wall starter strips—(may be made of pressure treated plywood): 65

Roof blocks
R=roof
Ed=edge (always 48")
S=starter
E=end
P=peak
Total counts include blocks that may be cut on site.
R24': 1
R32": 2
R48": 198
Red: 20
Re24: 2
Re32: 1
Re48: 19
Reed: 2
Rs24: 1
Rs48": 23
Rsed: 2

Rp24": 2
Rp48": 21
Rped: 2
Total roof block count: 296
Beam blocks
Standard 16": 36
16" end block: 1
16" end cap: 2
Standard 12": 4
12" end cap: 1
Total beam block count: 44
Structural Ties Structural ties may be breathable and in one embodiment, may be made from 16 gauge stainless steel mesh.

Roof/Wall Structural Tie: 23
Peak tie: 30
Square mesh tie: 25
Structural bracket: 5
Wood (Rough Cut Unless Noted Otherwise)
1½"×12"×12" under 12" beam: 1
1⅝"×12"×16" under 16" beam: 2
2'×6' roof starter block support (1 each):
37'-8" long
35'-8" long
11'-8" long
2' long
2×6 window/door headers and footers (dressed):
6'-4" long: 2 (master bedroom window)
9' long: 2 (living room window)
5' long: 1 (front door)
8'-4" long: 1 (back door/window)
3'-8½" long: 1 (back window footer)
6' long: 4 (bedroom windows)
2×4 window/door trim (dressed)
6'-8" long: 4 (doors)
3'-4" long: 8 (windows—not living room)
4'-8" long: 2 (living room windows)
Fasteners The fasteners used should be compatible with lime construction and can include stainless steel or ceramic coated fasteners.

Finish of the Structure

In an embodiment of the present invention, lime mortar or another suitable mortar may be brushed on all block faces that are adjacent to another block face. As a result, this can create a structure that is monolithic and sealed.

The interior walls of the structure of the present invention may be a lime rendering, which may be colored or have breathable paint applied over it. In an alternative embodiment, there is no further application required to the interior walls. In another embodiment, the interior walls may also be covered in panels of sheetrock, wood veneer or brick, preferably with approximately a minimum 1" air space constructed between the bricks and the interior paneling.

The exterior walls of the structure of the present invention may have a plain coat bio-fiber and lime finish applied. Such an application can add to monolithic quality and building strength with a more finished look and a non-fading or fading resistant color finish. In another embodiment, the exterior walls can have a mortar application, or "stucco look". Such an application can also add to monolithic quality and building strength with a more finished look and a non-fading or fading resistant color finish. In a further embodiment, typical wall siding brick veneer and other non permeable materials may be used, and should maintain a minimum 1" space from the block surface. In yet another embodiment, there is no further application required to the exterior walls, and the blocks may be formed with a decorative exterior surface on them. The blocks may have embossed or patterned surfaces for decorative or other purposes such as sound absorption, water-shedding, light reflectivity and so on.

Any roofing material known in the art may be used in conjunction with the roof of the present invention structure. If non-breathable material is used, there should be an approximately one inch minimum space between the non-breathing material and the roof block. In one embodiment, the roof may be coated, for example, with a 7 coat, 100 year lime finish. In an alternative embodiment, the roof may further comprise bio-fiber breathable "clay-like" tiles which may not require an air space.

Preferred Proposed Block Benefits

A most preferred embodiment of the present invention would possess some or all of the following characteristics:

Strong load bearing capabilities
Excellent insulating properties R26 to R40 or $\lambda$=0.07 W/m·K with 100% thermal break
Excellent fire rating
Environmentally sustainable, Carbon zero or negative co2 building material classification
Good thermal inertia and thermal mass characteristics to regulate inside temperature
Excellent air and humidity permeability
Conforms to existing building standards and dimensions making it easy for contractors and architects to implement. Conventional fasteners such as stainless steel or Ceramic coated screws may be used
Lightweight for ease of handling and requires no skilled labour for construction assembly
Very rapid construction, Constructed walls are weatherproof and finishes may be applied immediately. Factory prepared face surfaces require minimal interior and exterior finishing
Standard sizes may permit robotic or machine-assisted assembly at site
Integrated conduit paths within blocks to accommodate electrical and utilities In the preceding description, for purposes of explanation, numerous details are set forth in order to provide a thorough understanding of the embodiments of the invention. However, it will be apparent to one skilled in the art that these specific details are not required in order to practice the invention.

The above-described embodiments of the invention are intended to be examples only. Alterations, modifications and variations can be effected to the particular embodiments by those of skill in the art without departing from the scope of the invention.

What is claimed is:

1. A structural panel assembled of structural blocks with a tensioning system for contributing to lateral load bearing attributes of the panel, comprising:

a plurality of structural blocks, each structural block having opposed pin and aperture surfaces, opposed side surfaces and opposed end surfaces;

a plurality of load-bearing structural strut members embedded within each structural block, a pin end of each strut member extending from a pin surface of the structural block, wherein one or more of the embedded strut members comprises a lengthwise cavity therethrough;

a plurality of apertures extending within the structural block from the aperture surface opposite the pin surface of the structural block each of the apertures adapted for engaging with an extending pin end of a structural strut member of an adjacent structural block which then places an end of a structural strut member of the structural block adjacent to an end of a structural strut member of the adjacent structural block, each strut member extending a distance from a block's one surface and being positioned retracted by a like distance from the same blocks' opposite surface, the space from the retracted strut end to the block's surface being the aperture;

the stacked structural blocks causing the structural struts to also be stacked end-to-end through the panel formed by the stacked blocks, forming:

structural columns of structural strut members aligned to form compression load-bearing internal columns inside the panel;

conduits from one edge at a pin side of an outer block of the panel to the opposite edge of the panel at the aperture side of an aligned outer block of the panel to receive and accommodate tensioning means, the conduits comprised of lengthwise cavities within a column of stacked structural struts within the panel; and tensioning means positioned within the lengthwise conduits formed of the cavities of one or more embedded end-to-end adjacent strut members, wherein the cavities in the embedded strut members of end-to-end adjacent structural blocks align to form the conduit for receiving the tensioning means, the tensioning means within the assembled panel under tension;

the structural struts aligned within each block in parallel pairs, one strut of each pair parallel to and nearer to one side of the block and the other strut of the same pair parallel to and nearer to the opposite side of the block;

the apertures and protruding pin ends on the aperture surface and the pin surface, respectively, arrayed to easily align blocks to be stacked, the pins and apertures providing block self-alignment guides for assembly of blocks to form the panel; and the blocks within the panel further comprising a connecting web situated and embedded in the body of the structural blocks in between two strut members of a pair of strut members, the web being perpendicular to the longitudinal axis of the block and attached to both strut members of the pair of strut members.

2. The structural block tensioning system of claim 1, wherein the tensioning means comprises a cable.

3. The structural block tensioning system of claim 2, wherein the cable is a tensioned non-stretch cable.

4. The structural block tensioning system of claim 1, wherein the tensioning means comprises a rod.

5. The structural block tensioning system of claim 2, wherein the tensioning means further comprises a tensioning end assembly.

6. The structural block tensioning system of claim 5, wherein the tensioning end assembly is a hex swage tensioner.

7. The structural block tensioning system of claim 1, further comprising a strut cap positioned over the extending end of one or more of the embedded strut members.

8. The structural block tensioning system of claim 1, wherein the structural blocks are made from a primarily fibrous material and a primarily lime based material.

9. The structural block of claim 8, wherein the primarily fibrous material comprises hemp hurd, flax, corn stock, cereal grain, straw, cellulose strands or any combination thereof.

10. The structural block of claim 8, wherein the lime based material comprises one or more of hydraulic lime or hydrated lime.

11. The structural block tensioning system of claim 1, in a panel, floor, wall or roof of a structure.

12. The manufacture of a structure using the structural block tensioning system of claim 1.

* * * * *